US006955380B1

(12) United States Patent
Barr

(10) Patent No.: US 6,955,380 B1
(45) Date of Patent: Oct. 18, 2005

(54) DRAWER SAFETY LATCH

(76) Inventor: Sebastian Barr, 1344 W. Commerce, Brownstone, IN (US) 47220

( * ) Notice: Subject to any disclaimer, the term of this patent is extended or adjusted under 35 U.S.C. 154(b) by 0 days.

(21) Appl. No.: 10/713,418

(22) Filed: Nov. 14, 2003

(51) Int. Cl.[7] ..... E05C 19/06
(52) U.S. Cl. ..... 292/84; 292/303; 312/333
(58) Field of Search ..... 292/83–84, 89, 292/146, 152, 170, 203, 209, 224–225, 303; 312/333

(56) References Cited

U.S. PATENT DOCUMENTS

| | | | | | |
|---|---|---|---|---|---|
| 461,375 | A | | 10/1891 | Spaunhorst | |
| 1,241,192 | A | * | 9/1917 | Bruder | 292/83 |
| 1,618,126 | A | | 2/1927 | Himmelwright | |
| 3,522,963 | A | * | 8/1970 | Farnden | 292/83 |
| 3,841,518 | A | * | 10/1974 | Hines | 292/83 |
| 3,850,463 | A | | 11/1974 | Hawkins | |
| 3,971,237 | A | * | 7/1976 | Rasmussen | 292/87 |
| 4,378,948 | A | * | 4/1983 | Chrones | 292/76 |
| 4,416,477 | A | | 11/1983 | Bialobrzeski et al. | |
| 4,549,773 | A | * | 10/1985 | Papp et al. | 312/334.47 |
| 4,560,212 | A | * | 12/1985 | Papp et al. | 312/334.47 |
| 4,717,184 | A | | 1/1988 | Boyce | |
| 5,344,226 | A | | 9/1994 | Lee | |
| 5,445,451 | A | | 8/1995 | Harmony | |
| 5,626,372 | A | | 5/1997 | Vogt | |
| 5,645,304 | A | | 7/1997 | Richardson et al. | |
| 5,730,514 | A | | 3/1998 | Hashemi | |
| 5,795,044 | A | | 8/1998 | Trewhella, Jr. et al. | |
| 6,042,157 | A | * | 3/2000 | Shimotsu | 292/83 |
| 2003/0111942 | A1 | | 6/2003 | Judge et al. | |

* cited by examiner

*Primary Examiner*—Daniel P. Stodola
*Assistant Examiner*—Christopher Boswell
(74) *Attorney, Agent, or Firm*—Camoriano and Associates; Theresa Fritz Camoriano; Guillermo Camoriano

(57) ABSTRACT

A drawer safety latch automatically stops the drawer both when opening and closing the drawer. In a preferred embodiment, the safety latch is a one-piece design and includes a large, flat surface for stick-on mounting of the safety latch to the drawer without the need for screws or other fastening devices.

11 Claims, 3 Drawing Sheets

DRAWER SAFETY LATCH

BACKGROUND

The present invention relates to a drawer safety latch. More particularly, it relates to a drawer safety latch which can be installed very easily and operates simply. There are many known types of drawer safety latches, but they usually are difficult to install, difficult to operate, and typically only operate in one direction, to prevent a child from opening the drawer. In many cases, the latch permits the child to open the drawer enough to get his fingers into the drawer, and then permits the child to close the drawer on his fingers, which can result in injury to the child.

SUMMARY

The safety latch of the present invention may be placed so that the drawer opens just far enough for the user to be able to disengage the safety latch, but not enough to gain access to the contents of the drawer until the safety latch is disengaged. Once the drawer is opened far enough to engage the safety latch, the safety latch prevents the accidental closure of the drawer. In order to close the drawer, the user must intentionally disengage it. This prevents a child from closing the drawer on his fingers.

A preferred embodiment of the safety latch is very easy to install. It includes an adhesive strip and can be mounted quickly and easily to the drawer without the need for drilling or screws.

DESCRIPTION OF THE PREFERRED EMBODIMENT

Figures 1, 2:
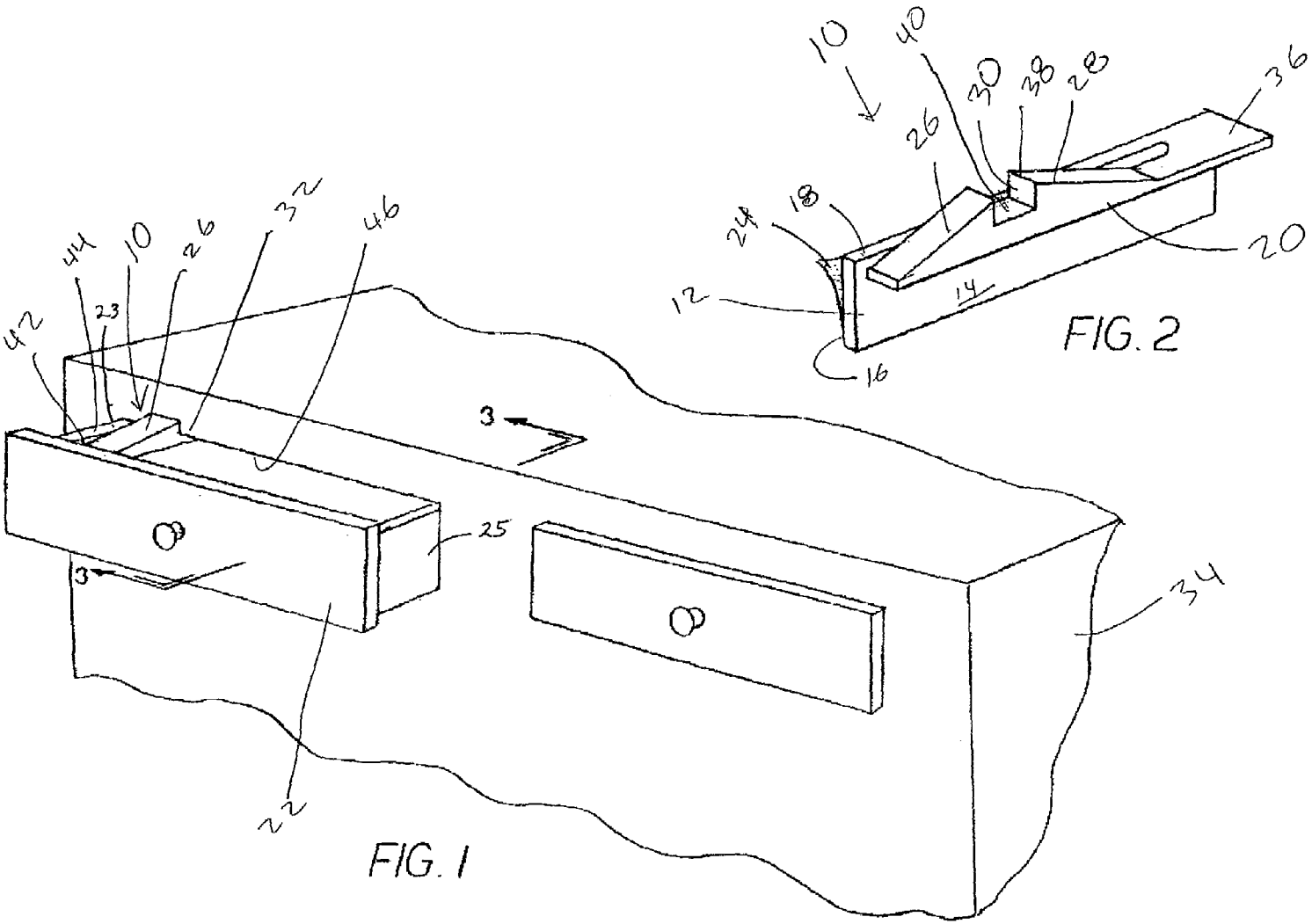
FIG. 1 is a perspective view of a cabinet with a drawer safety latch made in accordance with the present invention.
FIG. 2 is a perspective view of the drawer safety latch of FIG. 1.

The engaging arm 20 has a top surface including front and rear ramps 26, 28, which are collinear, and a trough 30 between the two ramps 26, 28. The trough 30 has substantially straight front and rear walls and defines an upward opening. Both of the ramps 26, 28 terminate short of that upward opening in a vertical plane, leaving the upward opening free to receive the front face of the cabinet, so the trough receives and abuts the front face of the cabinet and stops the travel of the drawer both when the drawer is opening and when the drawer is closing. As is explained in more detail later, the trough 30 has a depth which permits it to engage the front face of the cabinet 34 (see FIG. 3). The top surface of the front ramp 26 tapers from a lower elevation in front to a higher elevation in back, where it meets the trough 30. The top surface of the rear ramp 28 tapers from a higher elevation in front, where it meets the trough 30, to a lower elevation in back.

The vertical leg 12 has an inside face 14, a flat outside face 16, and a top surface 18. In this embodiment 10, there is an adhesive strip adhered to the outside face 16, including a peel-off protective sheet 24, which covers the adhesive strip until the user is ready to install the safety latch 10 in the drawer 22, at which time he peels off the protective sheet 24 to expose the adhesive surface in order to adhere the vertical leg 12 to the side of the drawer 22.

FIGS. 1–8 show a drawer safety latch 10 made in accordance with the present invention. Referring to FIGS. 2, 4, 5, and 6, the safety latch 10 is a substantially "L" shaped body (seen best in FIG. 6), including a vertical leg 12, a horizontal leg 36 projecting inwardly from said vertical leg 12, and an engaging arm 20 projecting forward from said horizontal leg 36. The vertical leg 12 lies in one plane, and the engaging arm 20 extends along a second plane that is parallel to and offset from the vertical leg.

The engaging arm 20 is cantilevered from the horizontal leg 36, and pivots upwardly and downwardly parallel to the vertical leg 12 by means of flexing of the latch material between the engaging arm 20 and the horizontal leg 36. The engaging arm 20 may be deflected by pushing it down until the apex 38 of the second ramp 28 is below the cross bar 32, allowing the drawer to open. The engaging arm 20 is naturally biased to spring back up when it is not being deflected downwardly.

Figure 3:
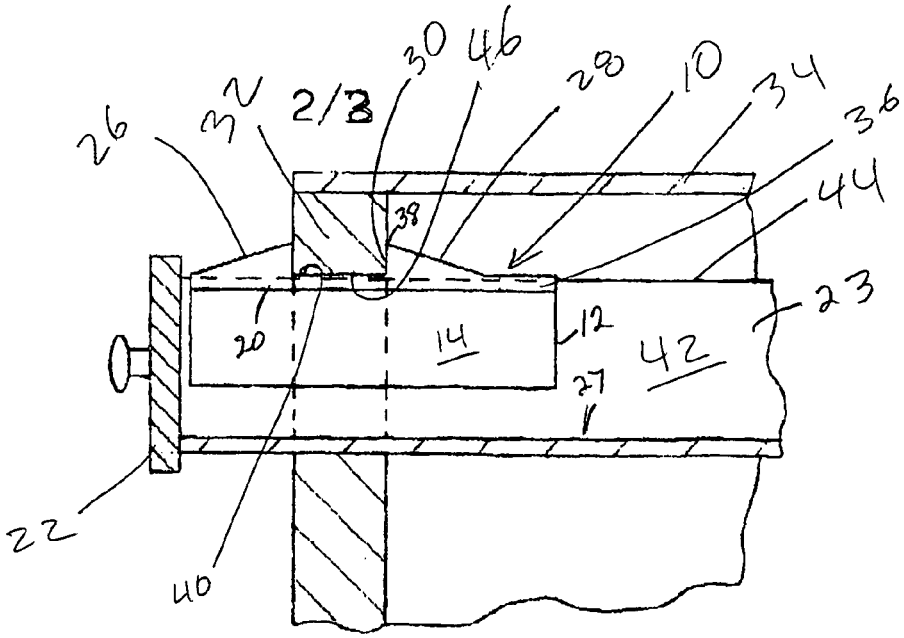
FIG. 3 is a view along line 3—3 of FIG. 1.
Figure 4:
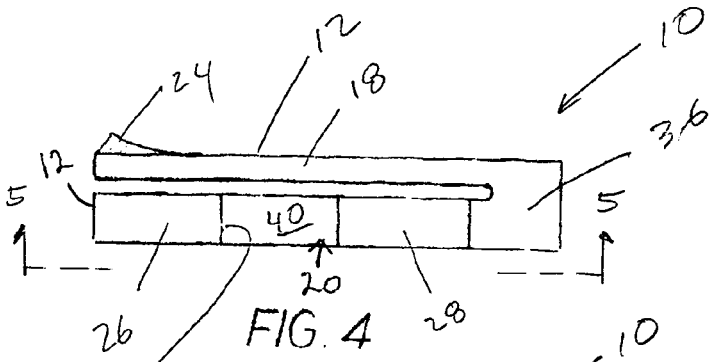
FIG. 4 is a plan view of the drawer safety latch of FIG. 2.
Figure 5:
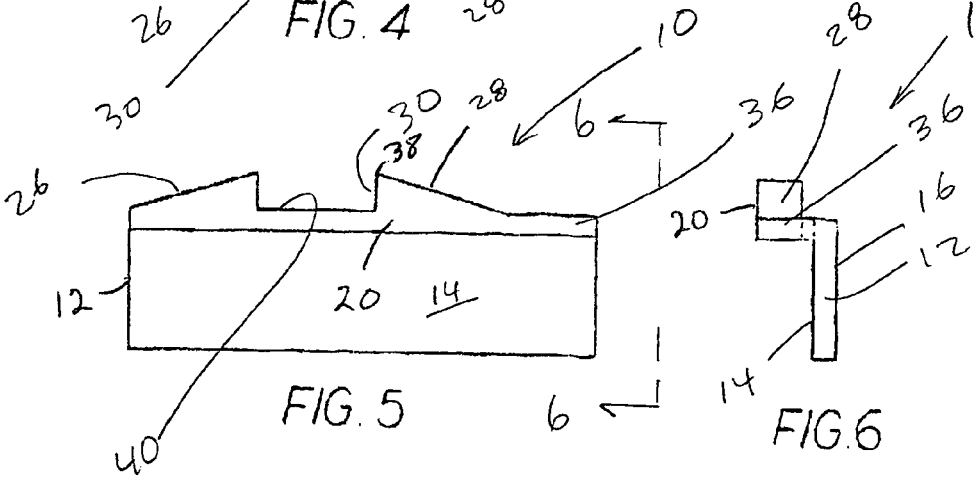
FIG. 5 is a view along 5—5 of FIG. 4.
Figure 6:
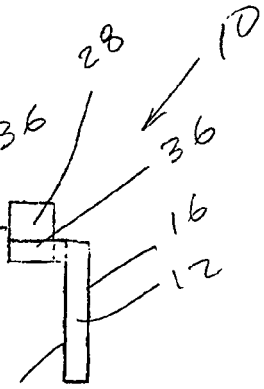
FIG. 6 is a view along 6—6 of FIG. 5.
Figure 7:
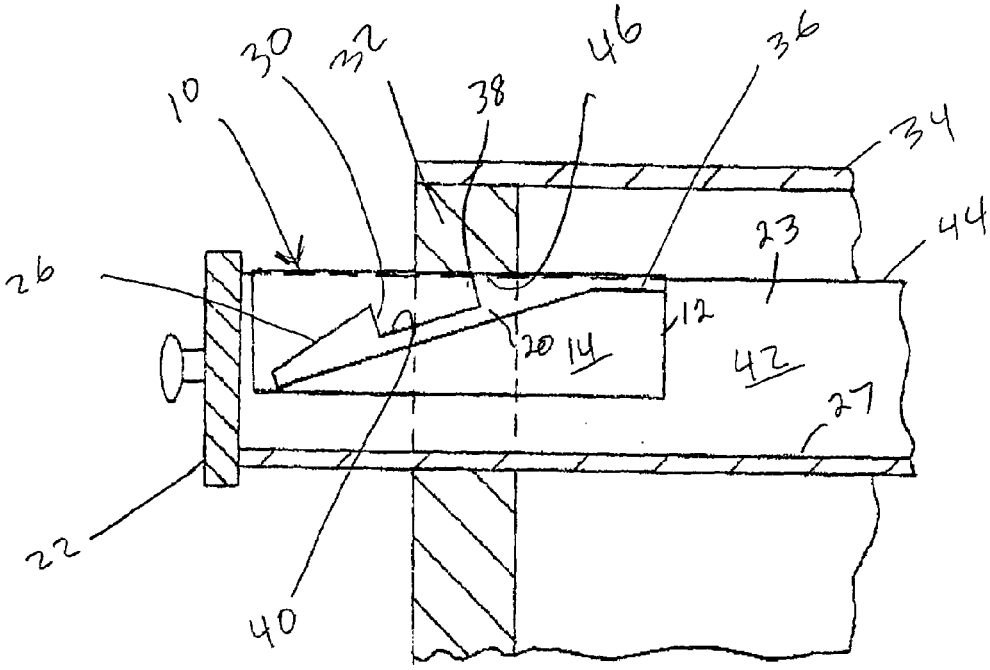
FIG. 7 is the same as FIG. 3, but with the drawer opened beyond the detent of the safety latch.

As seen in FIGS. 1 and 3, the cabinet 34 has a frame and a front face which includes the cross bar 32. The front face defines an opening 46 through which the drawer 22 passes as it moves forward and backward relative to the cabinet 34. The front face and its cross bar 32 have a front-to-back depth, and the trough 30 on the latch 10 is deep enough to receive the cross bar 32. The drawer 22 has left and right sides 23, 25 and a bottom 27.

The safety latch 10 is mounted inside of the drawer 22 such that the outside face 16 of the vertical leg 12 of the safety latch 10 lies against the inside surface 42 of the left side 23 of the drawer 22. The protective sheet 24 has been peeled off of the outside face 16, allowing the vertical leg 12 to be adhered to the side 23 of the drawer 22. To facilitate the installation, the safety latch 10 is mounted such that the upper surface 18 of the vertical leg 12 is parallel to, and flush with, the upper edge 44 of the side 23 of the drawer 22.

Figure 8:
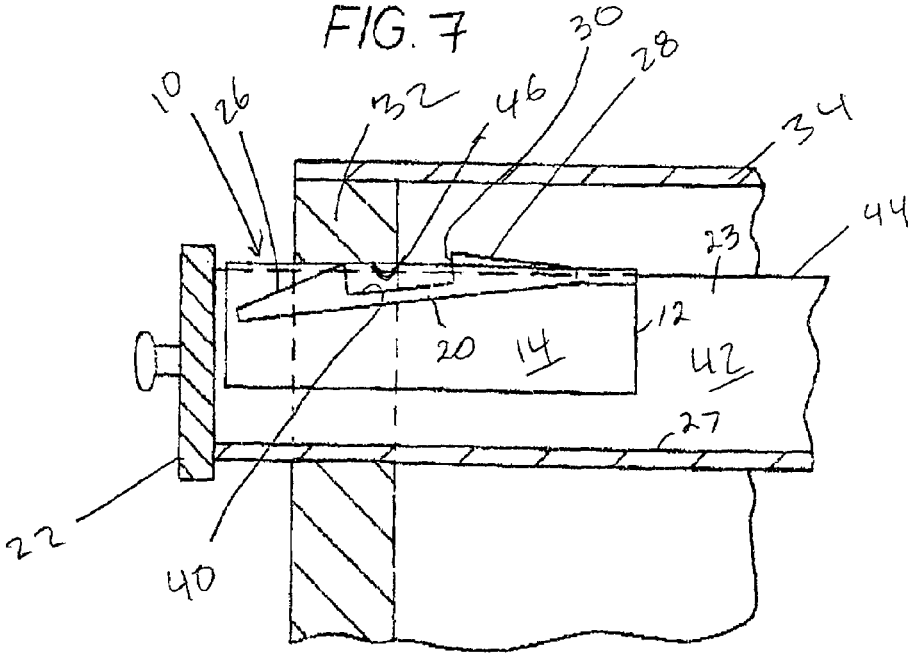
FIG. 8 is the same as FIG. 7, but with the drawer closed beyond the detent of the safety latch.

As seen in FIG. 8, as the drawer 22 is first opened, the cross bar 32 portion of the front face of the cabinet 34 bears down on the front ramp 26 of the engaging arm 20. The ramp 26 rides along the cross bar 32, flexing the engaging arm 20 further and further downwardly as the drawer 22 is pulled out, until the trough 30 reaches the cross bar 32. At that point, the engaging arm 20 snaps back and receives the cross bar 32 within the trough 30 (as seen in FIG. 3). Now, the rear vertical surface of the trough 30 abuts the rear surface of the cross bar 32, preventing any forward movement of the drawer 22, and the front vertical surface of the trough 30 abuts the front surface of the cross bar 32, preventing rearward movement of the drawer 22. Thus, in this position, the latch 10 prevents the drawer 22 from moving inwardly or outwardly.

In order to open or close the drawer 22 from the position shown in FIG. 3, the user pushes down on the front ramp 26 of the safety latch 10 until the respective ramp 26 or 28 clears the bottom 46 of the cross bar 32, and then, while the safety latch 10 is in this downwardly deflected position, the user pulls or pushes on the drawer 22 to further open or close the drawer 22.

If the drawer 22 is opened, so that the entire latch 10 is forward of the cross bar 32, then, as the drawer 22 is pushed closed, the cross bar 32 bears down on the rear ramp 28, again causing the engaging arm 20 to flex downwardly. Again, as soon as the drawer 22 is closed enough that the trough 30 reaches the cross bar 32 (as seen in FIG. 3), the engaging arm 20 snaps back up to receive the cross bar 32 within the trough 30, preventing any further movement of the drawer 22 in the forward or rearward direction. Once again, the user pushes down on the front of the engaging arm 20 to release the cross bar 32 from the trough before opening or closing the drawer any further.

In this preferred embodiment 10, the safety latch 10 is made as a single piece from a strong and flexible material, such as plastic, such that the engaging arm 20 may be readily deflected downwardly when acted upon by either the cross bar 32 or by the user, and such that it also will snap back upwardly when it is released.

The safety latch 10 may typically be installed as close as possible to the front face of the drawer 22 such that the drawer 22 opens just far enough for the user to be able to push down on the front ramp 26 of the safety latch 10 to disengage the engaging arm 20, but not far enough for a hand to reach into the drawer 22 and grab or pull out any of its contents. The distance between the front face of the drawer and the front face of the cabinet when the latch is latched, as shown in FIG. 3, should be great enough that a child's fingers will not be pinched between the drawer and the cabinet when the drawer is in the latched position.

The embodiment described above shows a simple and effective arrangement for providing a safety latch for a drawer which prevents a child from getting access to the contents of the drawer and prevents the child from pinching his fingers in the drawer. It will be obvious to those skilled in the art that modifications may be made to the embodiment described above without departing from the scope of the present invention.

What is claimed is:

1. A safety latch for a drawer, comprising:

an L-shaped body, including a vertical leg and a horizontal engaging arm, said vertical leg having a top surface and having a flat outer surface for mounting to the inside of a drawer, wherein said L-shaped body is configured so that the horizontal engaging arm will project inwardly into the drawer when the flat outer surface of the vertical leg is mounted to the inside of a vertical wall of the drawer; and said engaging arm having a top surface defining forward and rear ramps and a trough between said forward and rear ramps, said trough defining an upward opening, and said ramps terminating short of said upward opening in a vertical plane;

wherein said engaging arm is movable up and down relative to said vertical leg; and wherein the top surface of said engaging arm, including at least a portion of said trough, is at a higher elevation than the top surface of said vertical leg when said L-shaped body is in a relaxed, unflexed position, so that, when said vertical leg is mounted to the inside of a vertical wall of the drawer flush with the top of the drawer, the top surface of said engaging arm and at least a portion of said trough project above the top of the drawer.

2. A safety latch for a drawer as recited in claim 1, wherein said L-shaped body is made in a unitary piece, and wherein said engaging arm projects forward from said horizontal leg and is movable by flexing said unitary piece.

3. A safety latch for a drawer as recited in claim 2, and further comprising a fastening means on said vertical leg for securing said vertical leg to the inside of a drawer.

4. A safety latch for a drawer as recited in claim 3, wherein said fastening means comprises an adhesive strip.

5. A safety latch for a drawer as recited in claim 2, wherein said forward ramp tapers from a lower elevation in front to a higher elevation in back, and said rear ramp tapers from a higher elevation in front to a lower elevation in back.

6. A safety latch for a drawer as recited in claim 1, wherein said forward ramp tapers from a lower elevation in front to a higher elevation in back, and said rear ramp tapers from a higher elevation in front to a lower elevation in back.

7. A safety latch for a drawer as recited in claim 1, wherein said trough has substantially straight front and rear walls.

8. A cabinet, comprising:

a frame;

a front face mounted on said frame and defining an opening having a front-to-back depth;

a drawer mounted on said frame and movable in a front-to-back direction through said opening, said drawer including left and right side panels and a bottom panel and defining an inner surface;

a safety latch including an L-shaped body, having a vertical leg, mounted on said inner surface, a horizontal leg projecting from said vertical leg; and a horizontal engaging arm projecting forward from said horizontal leg and having a top surface which defines forward and rear ramps and a trough between said ramps, said trough defining an upward opening having a front-to-back distance that is at least as deep as the front-to-back depth of said front face; wherein said forward ramp tapers from a lower elevation in front to a higher elevation in back, and said rear ramp tapers from a higher elevation in front to a lower elevation in back; and said latch is mounted at a height such that said trough receives said front face and stops the movement of said drawer both when the drawer is being opened and when it is being closed.

9. A cabinet as recited in claim 8, wherein said latch is a unitary piece, and said engaging arm is movable up and down parallel to said vertical leg by flexing between said engaging arm and said horizontal leg.

10. A drawer latch for use in a cabinet having a front face and at least one drawer, comprising:

a one-piece L-shaped latch body, including a vertical leg; a horizontal leg projecting inwardly from said vertical leg; and an engaging arm projecting from said horizontal leg along a plane that is parallel to and offset from the plane of said vertical leg;

means for mounting said latch body to the inside of a drawer; and means for stopping the drawer by abutting the front face of the cabinet both when opening and closing the drawer, wherein said means for stopping the drawer includes said engaging arm having a top surface defining forward and rear ramps and a trough between said forward and rear ramps.

11. A drawer latch as recited in claim 10, wherein said one-piece latch body includes means for selectively releasing said latch from the front face of the cabinet in order to open and close the drawer.

* * * * *

UNITED STATES PATENT AND TRADEMARK OFFICE

CERTIFICATE OF CORRECTION

PATENT NO. : 6,955,380 B1
DATED : October 18, 2005
INVENTOR(S) : Sebastian Barr

It is certified that error appears in the above-identified patent and that said Letters Patent is hereby corrected as shown below:

Column 1, line 51 - Column 2, line 17,
The first three paragraphs should be replaced with the following:

-- FIGS. 1-8 show a drawer safety latch 10 made in accordance with the present invention. Referring to FIGS. 2, 4, 5, and 6, the safety latch 10 is a substantially "L" shaped body (seen best in FIG. 6), including a vertical leg 12, a horizontal leg 36 projecting inwardly from said vertical leg 12, and an engaging arm 20 projecting forward from said horizontal leg 36. The vertical leg 12 lies in one plane, and the engaging arm 20 extends along a second plane that is parallel to and offset from the vertical leg.

The vertical leg 12 has an inside face 14, a flat outside face 16, and a top surface 18. In this embodiment 10, there is an adhesive strip adhered to the outside face 16, including a peel-off protective sheet 24, which covers the adhesive strip until the user is ready to install the safety latch 10 in the drawer 22, at which time he peels off the protective sheet 24 to expose the adhesive surface in order to adhere the vertical leg 12 to the side of the drawer 22.

UNITED STATES PATENT AND TRADEMARK OFFICE

CERTIFICATE OF CORRECTION

PATENT NO. : 6,955,380 B1
DATED : October 18, 2005
INVENTOR(S) : Sebastian Barr

It is certified that error appears in the above-identified patent and that said Letters Patent is hereby corrected as shown below:

Column 1, line 51 - Column 2, line 17 (cont'd),

The engaging arm 20 has a top surface including front and rear ramps 26, 28, which are collinear, and a trough 30 between the two ramps 26, 28. The trough 30 has substantially straight front and rear walls and defines an upward opening. Both of the ramps 26, 28 terminate short of that upward opening in a vertical plane, leaving the upward opening free to receive the front face of the cabinet, so the trough receives and abuts the front face of the cabinet and stops the travel of the drawer both when the drawer is opening and when the drawer is closing. As is explained in more detail later, the trough 30 has a depth which permits it to engage the front face of the cabinet 34 (see FIG. 3). The top surface of the front ramp 26 tapers from a lower elevation in front to a higher elevation in back, where it meets the trough 30. The top surface of the rear ramp 28 tapers from a higher elevation in front, where it meets the trough 30, to a lower elevation in back. --.

Signed and Sealed this

Twenty-eighth Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,955,380 B1
APPLICATION NO. : 10/713418
DATED : October 18, 2005
INVENTOR(S) : Sebastian Barr It is certified that error appears in the above-identified patent and that said Letters Patent is hereby corrected as shown below:

Column 3, claim 1; line 38

Replace entire claim 1 with the following:

1. A safety latch for a drawer, comprising:

an L-shaped body, including a vertical leg; and a horizontal leg projecting inwardly from said vertical leg; and an engaging arm projecting from said horizontal leg along a plane parallel to and offset from said vertical leg, said vertical leg having a flat outer surface for mounting to the inside of a drawer, and said engaging arm having a top surface defining forward and rear ramps and a trough between said forward and rear ramps, said trough defining an upward opening, and said ramps terminating short of said upward opening in a vertical plane;

wherein said engaging arm is movable up and down relative to said vertical leg.

Signed and Sealed this

Fourth Day of July, 2006

JON W. DUDAS
*Director of the United States Patent and Trademark Office*